US005542876A

United States Patent [19]

Field, Jr.

[11] Patent Number: 5,542,876

[45] Date of Patent: Aug. 6, 1996

[54] V-PROFILE GRINDING WHEEL

[75] Inventor: Edgar L. Field, Jr., Muskogee, Okla.

[73] Assignee: Coburn Optical Industries, Inc., Tulsa, Okla.

[21] Appl. No.: 293,227

[22] Filed: Aug. 19, 1994

[51] Int. Cl.[6] ..... B23F 21/03; B23F 21/23; B24B 5/00; B24B 7/16

[52] U.S. Cl. ..... 451/540; 451/43; 451/255; 451/256; 451/547; 451/541

[58] Field of Search ..... 451/540, 542, 451/548, 240, 258, 259, 43, 58, 255, 256, 547, 541

[56] References Cited

U.S. PATENT DOCUMENTS

| | | | |
|---|---|---|---|
| 3,673,738 | 7/1972 | Stern | 451/240 |
| 3,894,361 | 7/1975 | Georgiadis et al. | 451/240 |
| 3,919,811 | 11/1975 | Hedelin | 451/540 |

FOREIGN PATENT DOCUMENTS

| | | | |
|---|---|---|---|
| 60-238265 | 11/1985 | Japan | 451/240 |

*Primary Examiner*—Bruce M. Kisliuk
*Assistant Examiner*—George Nguyen
*Attorney, Agent, or Firm*—Frank J. Catalano; Scott R. Zingerman

[57] ABSTRACT

A grinding wheel for V-profiling ophthalmic lenses of various diameters, powers and thicknesses has a V-shaped groove circumferentially thereabout which defines a forward V surface and a rear V surface meeting at a nadir of the groove. A rear flat surface tapers outwardly in relation to an axis of rotation of the wheel from a rear edge of the rear V surface toward a rear face of the wheel. The forward V surface is of a first grinding aggressiveness, the rear V surface is of second grinding aggressiveness greater than the first grinding aggressiveness and the rear flat surface is of third grinding aggressiveness substantially greater than the second grinding aggressiveness. In a preferred embodiment, the wheel also has a forward flat surface tapering outwardly in relation to the axis of rotation of the wheel from a forward edge of the forward V surface toward a forward face of the wheel. The forward flat surface is of grinding aggressiveness substantially greater than the second grinding aggressiveness and equal to or less than the grinding aggressiveness of the rear flat surface.

2 Claims, 3 Drawing Sheets

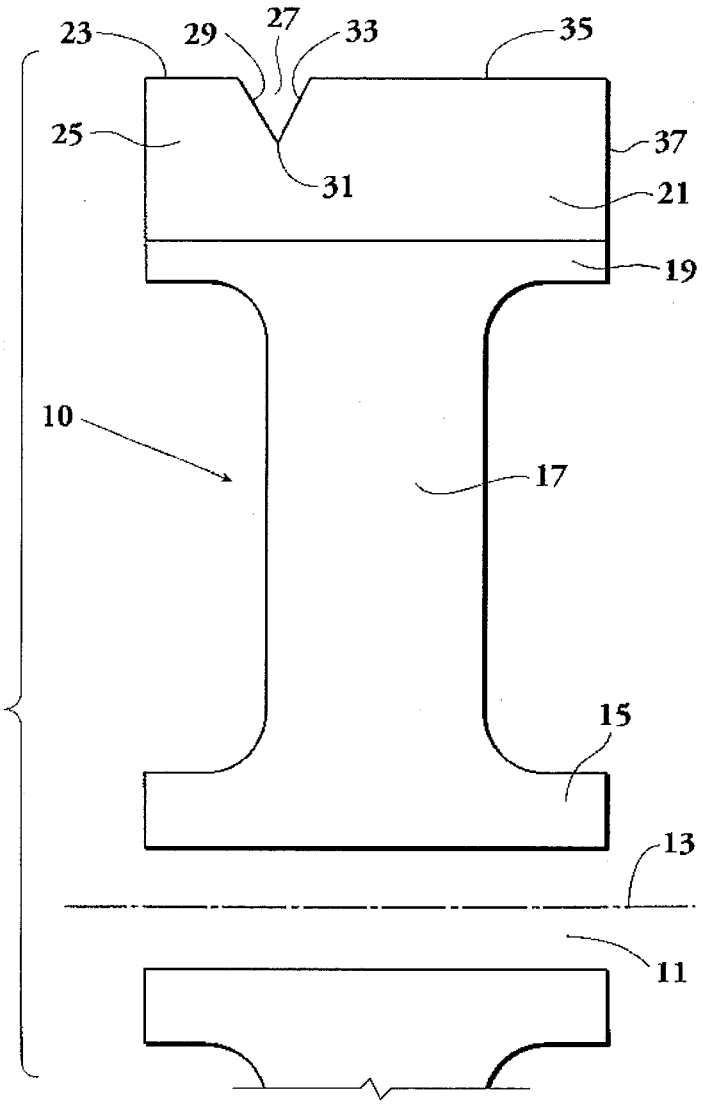
Fig. 5
Fig. 2
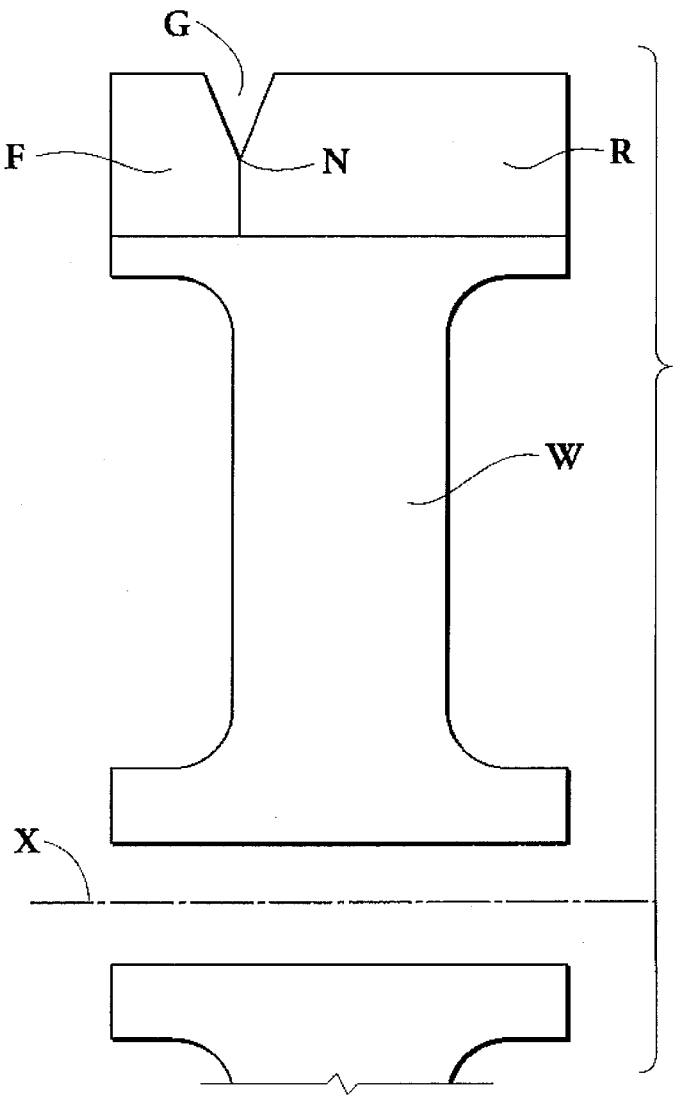

V-PROFILE GRINDING WHEEL

BACKGROUND OF THE INVENTION

This invention relates generally to grinding wheels for ophthalmic lenses and more particularly concerns grinding wheels for V-profiling the edges of ophthalmic lenses.

Ophthalmic lenses are secured in a frame by tightening the frame around a V-profile ground along the edge of the lens and at or proximate the front face of the lens with the V-profile disposed in a groove in the frame. It is desirable to grind the lens and the V-profile to as precise a diameter as possible to fit tightly within the groove of the frame. However, the same frame may be used to hold plus power lenses which are thicker at their centers and thinner at their edges, plano lenses which are of substantially constant thickness and minus power lenses which are thinner at their centers and thicker at their edges. The thickness of each of these lenses also varies according to the magnitude of power required. Depending on the lens power and overall lens thickness, the thickness of the lens edge to be ground can vary considerably. This variation in lens edge thickness is a likely contributor to variations in the accuracy of V-profile lens diameters.

It is therefore a primary object of this invention to provide a V-profile grinding wheel for grinding an ophthalmic lens. It is another object of this invention to provide a V-profile grinding wheel for grinding an ophthalmic lens to fit tightly within the groove of a given frame. It is a further object of this invention to provide a V-profile grinding wheel for grinding an ophthalmic lens to fit tightly within the groove of a given frame regardless of the diameter of the frame. Yet another object of this invention is to provide a V-profile grinding wheel for grinding an ophthalmic lens to fit tightly within the groove of a given frame regardless of the power of the lens. It is also an object of this invention to provide a V-profile grinding wheel for grinding an ophthalmic lens to fit tightly within the groove of a given frame regardless of the thickness of the lens edge.

SUMMARY OF THE INVENTION

In accordance with the invention, a grinding wheel for V-profiling ophthalmic lenses of various diameters, powers and thicknesses has a V-shaped groove circumferentially thereabout which defines a forward V surface and a rear V surface meeting at a nadir of the groove. A rear flat surface tapers outwardly in relation to an axis of rotation of the wheel from a rear edge of the rear V surface toward a rear edge of the wheel. The forward V surface is of a first grinding aggressiveness, the rear V surface is of second grinding aggressiveness greater than the first grinding aggressiveness and the rear flat surface is of third grinding aggressiveness substantially greater than the second grinding aggressiveness. In a preferred embodiment, the wheel also has a forward flat surface tapering outwardly in relation to the axis of rotation of the wheel from a forward edge of the forward V surface toward a forward face of the wheel. The forward flat surface is of grinding aggressiveness substantially greater than the second grinding aggressiveness and equal to or less than the grinding aggressiveness of the rear flat surface.

As a result, the flat surfaces of the lens are ground away at a faster rate, regardless of the thickness of the edge of the lens. Since the flat surfaces are more quickly ground away, the grinding process time is maximized for the condition in which only the V-surfaces contact the lens. Since the V-portion of the grinding wheel is always the same width regardless of the thickness of the lens, then lenses of all powers and thicknesses experience substantially the same V-profile grinding force for the major portion of the process. Therefore, deviation in lens diameter over a wide range of lens thicknesses and powers is minimized.

BRIEF DESCRIPTION OF THE DRAWINGS

Other objects and advantages of the invention will become apparent upon reading the following details description and upon reference to the drawings in which:

FIG. 2 is an exploded, partial diametric view of a known V-profile grinding wheel;

FIG. 5 is an exploded partial diametric view of a preferred embodiment of a V-profile grinding wheel according to the present invention.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1C:
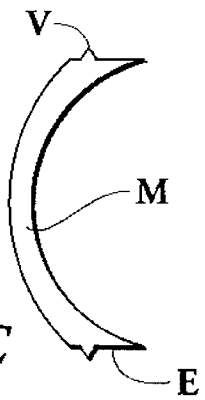
FIG. 1C is a side elevation view illustrating a typical V-profiled minus power lens.
Figure 1B:
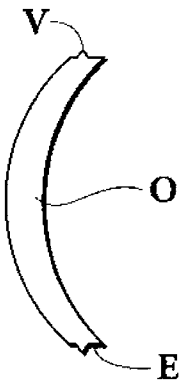
FIG. 1B is a side elevation view illustrating a typical V-profiled plano lens.
Figure 1A:
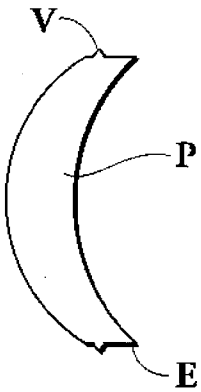
FIG. 1A is a side elevation view illustrating a typical V-profiled plus power lens.

Turning to FIGS. 1A, 1B and 1C, typical plus power P, plano O and minus power M lenses are illustrated having a V-profile ground proximate the front faces of the lenses. The edge thickness E of each of the lenses is dependent upon both the thickness and the power of the lens. However, regardless of the thickness of the edge E, the V-profile to be ground is the same.

In a typical grinding process for contouring a lens to a frame, a rough grinding wheel is first used to grind the lens to a diameter approximately 1 millimeter larger than the desired frame diameter. The rough ground lens is then V-profiled to provide a ridge along the edge of the lens for engagement with a groove in the frame. This is typically accomplished by a well-known free floating grinding wheel operation. The lens rotates in fixed position about an axis through its center and the edge of the lens changes position along this axis depending on the radius of curvature of the lens. The grinding wheel rotates about an axis parallel to the lens axis. The position of the grinding wheel shifts in the direction of the lens axis to align the wheel with the lens. The position of the wheel axis then shifts to bring the grinding surface into contract with the lens. The grinding wheel is spring biased toward the lens. Once the wheel is in close proximity to the lens, control of the positioning of the grinding wheel in the direction of the lens axis is released and the wheel rotates on free float bearings in relation to the lens. The system is sometimes oppositely arranged, the lens floating and the grinding wheel being on a fixed axis.

As shown in FIG. 2, currently known grinding wheels W have different grades of grinding surfaces which meet at the nadir N of their V-profile groove G. The forward grinding surface F of the wheel W which extends from the nadir N toward the front face of the lens includes a forward V surface and a forward flat surface. The rear grinding surface R of the wheel W which extends from the nadir N toward the rear face of the lens includes a rear V surface and a rear flat surface. The forward grinding surface F is formed from a less aggressive or less coarse grit than the rear grinding surface R. The forward and rear flat surfaces of the wheel are radially more distant from the wheel axis X at their outer edges than at their junctures with the forward and rear V surfaces of the wheel W. Because of this slight taper toward the groove G, when the wheel W is in contact with the lens, the wheel W naturally shifts along its axis X to align the lens with the groove G of the wheel W. The groove G is closer to the forward portion of the wheel W than the rear. Because the rear flat surface of the grinding wheel W is more aggressive than the forward flat surface of the grinding wheel W, the rear flat surface of the grinding wheel W cuts away more lens material. As a result, since there is no longer sufficient contact between the rear flat surface of the grinding wheel W and the lens to prevent it, the wheel W tends to float toward the front surface of the lens. Therefore, the V-profile is ground more proximate the front edge of the lens.

Figure 3:
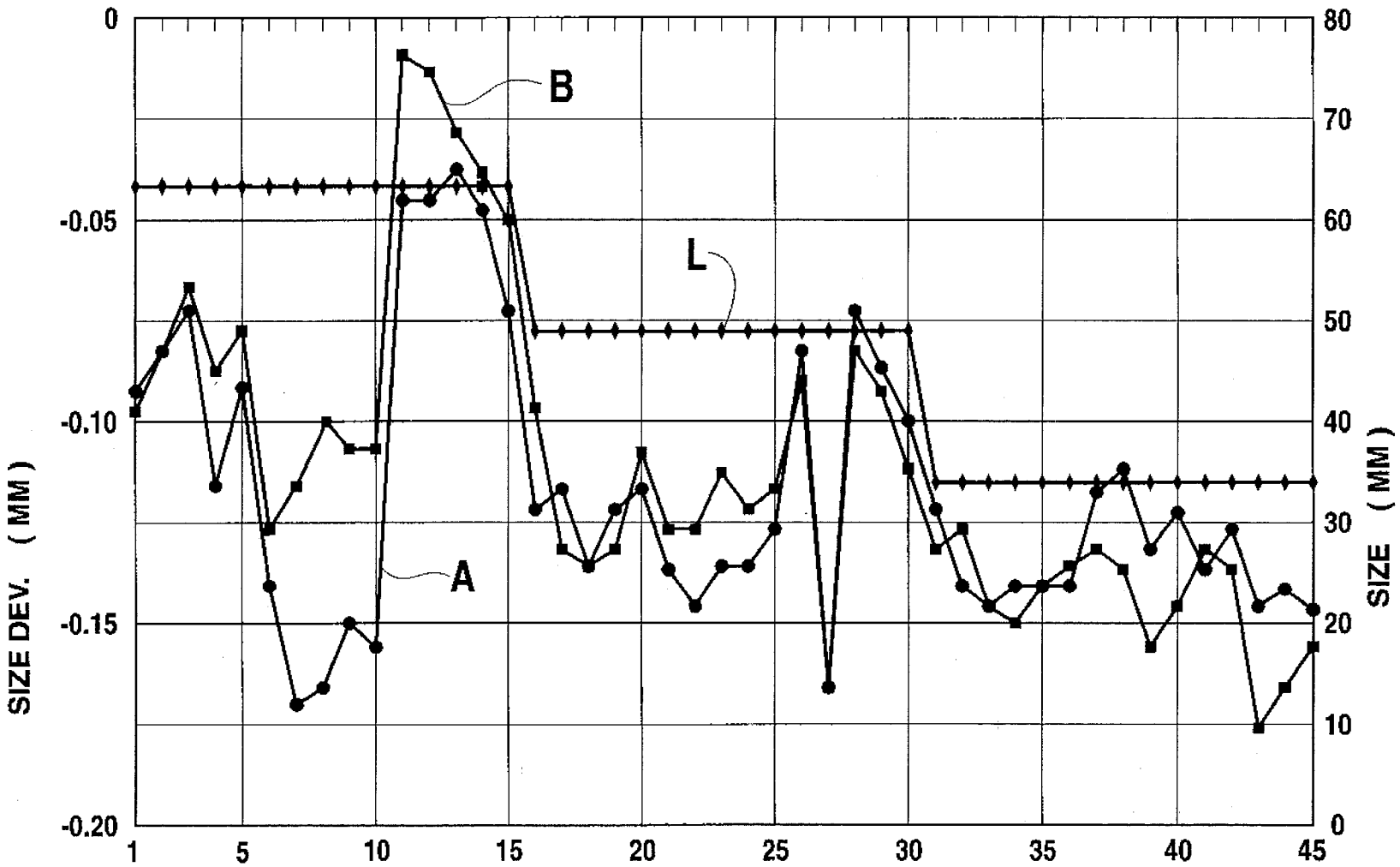
FIG. 3 is a graphic representation of the A-Box and B-box deviations experienced in grinding lenses of various diameters to a V-profile using a known grinding wheel such as that illustrated in FIG. 2.

It is generally known that, for any given frame, lenses P, O and M of varying power, thickness and diameter profiled by known V-profile grinding wheels W are not so consistently contoured as to each precisely fit the frame. To determine whether any pattern of inconsistency could be established, forty-five lenses were ground using one of these known V-profile wheels W. As shown in curve L of FIG. 3, lenses 1–15 were 65 millimeters in diameter, lenses 16–30 were 50 millimeters in diameter and lenses 31–45 were 35 millimeters in diameter prior to V-profiling. In each of these groups of fifteen lenses, the first five, 1–5, 16–20 and 31–35, were plano lenses O, the second five, 6–10, 21–25 and 36–40, were plus power lenses P and the third five, 11–15, 26–30 and 41–45, were minus power lenses M. All forty-five of the lenses were ground to V-profile for the same time interval and at the same rotation speed. Deviations in the V-profiled lenses were then measured in A-Box and B-Box parameters, A-Box being the horizontal distance across a rectangle framing the V-profiled lens and B-Box being the vertical distance across that rectangle. A-box data was recorded as curve A and B-box data recorded as curve B. Using known grinding wheels W, greater inconsistency in deviation resulted for greater diameter lenses. Furthermore, less deviation resulted with respect to the 65 millimeter minus power lens M than for 65 millimeter plus power P or plano O lenses or even smaller plus power P or plano O lenses.

Figure 4:
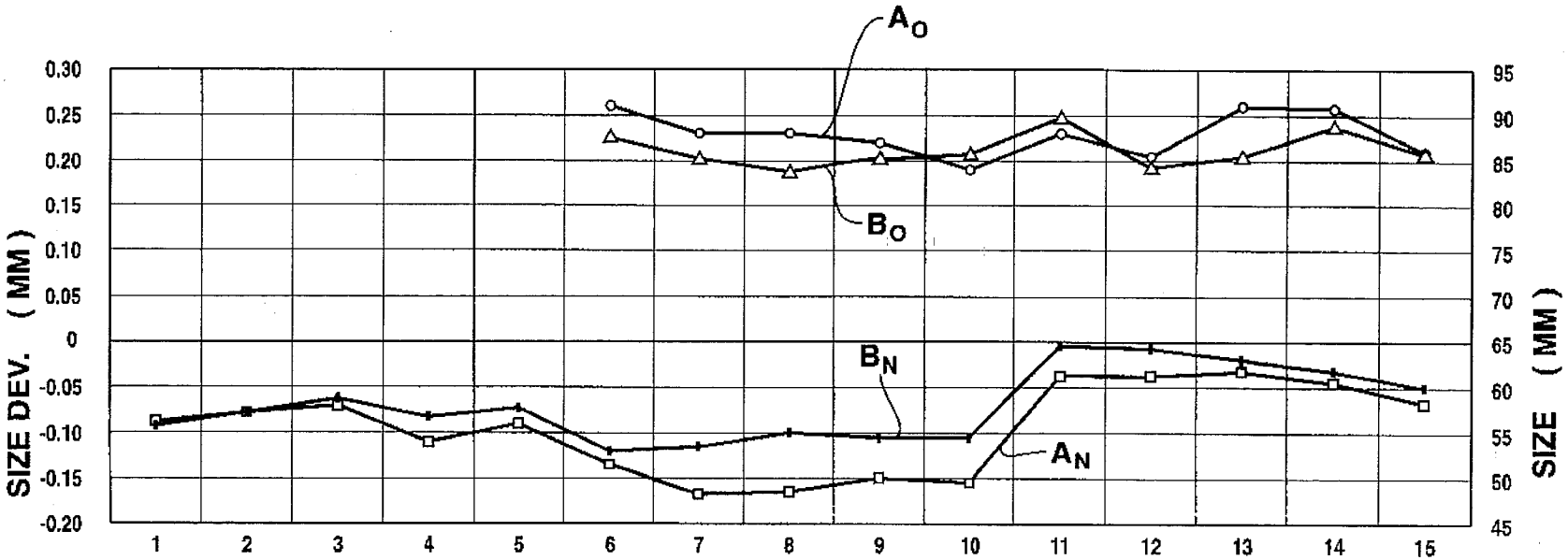
FIG. 4 is a graphic comparison of the A-box and B-box deviations experienced in grinding lenses to a V-profile using a known grinding wheel such as that illustrated in FIG. 2 before and after the V-portions of its grinding surface have been dulled.

Turning to FIG. 4, evaluation of the deviation relative to 65 millimeter lenses is further considered. Five plano lenses O, 1–5, five plus power lenses P, 6–10, and five minus power lenses M, 11–15, were ground to a V-profile using a known grinding wheel W. The deviations were measured in the A-box and B-box parameters. The A-box data was recorded as curve $A_N$ and the B-box data recorded as curve $B_N$. As shown, using the known grinding wheel W without modification resulted in all fifteen of the lenses being ground to a diameter smaller than the intended 65 millimeters. The deviation in accuracy was greatest between the plus power P and minus power M lenses (as much as 0.15 millimeters of deviation). The V-portion of the wheel W was then dulled and the process repeated for the plus power P and minus power M lenses. Five plus power P lenses, 6–10 and five minus power lenses M, 11–15, were ground using the wheel W with dulled V-portions and the A-box and B-box data recorded as curves $A_D$ and $B_D$, respectively. Using the wheel W with dulled V-portions resulted in all of the lenses being ground to a diameter somewhat larger than the intended 65 millimeters. The deviation between lenses was maintained within an approximate range of 0.05 millimeters for all of the lenses. Any variation from the zero reference (which corresponds to the desired lens diameter and, in the above tests, is 65 millimeters), is known to be correctable by calibration of the grinding machine to compensate for the special characteristics of each machine and grinding wheel W. However, the above data illustrates that, by varying the relative aggressiveness of the flat and V surfaces of the wheel, deviations in V-profile diameter can be reduced. That is, a grinding wheel W having more aggressive flat grinding surfaces in relation to its V-grinding surfaces produces closer tolerances of V-profile diameter for plus power P and minus power M lenses.

Considering the foregoing, it is concluded that, if the flat surfaces of the grinding wheel are more aggressive or coarse than the V surfaces of the grinding wheel, then the front and rear portions of the lens will be ground away at a faster rate, regardless of the thickness of the edge of the lens. Since the flat surfaces are more quickly ground away, the grinding process time is maximized for the condition in which only the V surfaces contact the lens. Since the V-portion of the grinding wheel is always the same width regardless of the thickness of the lens, then lenses of all powers and thicknesses will experience substantially the same V-profile grinding force for the major portion of the process. Therefore, deviation in lens diameter over a wide range of lens thicknesses and powers is minimized.

In accordance with this conclusion, the grinding wheel 10 of the present invention is illustrated in FIG. 5. As shown, the grinding wheel 10 has a central bore 11 into which a shaft (not shown) can be inserted for rotation of the wheel 10 about its axis 13. From the central portion 15 of the wheel 10, a thinner web portion 17 extends outwardly to a thicker base portion 19. Mounted circumferentially around the base portion 19 is the grinding portion 21 of the wheel 10. The outer surface of the grinding portion 21 is divided into a forward flat surface 23 extending from the forward face 25 of the wheel 10 to the V-portion 27 of the wheel 10, a forward V surface 29 extending from the rear edge of the forward flat surface 23 to the nadir 31 of the V-portion 27, a rear V surface 33 extending from the nadir 31 to a forward edge of a rear flat surface 35 and the rear flat surface 35 which extends to the rear face 37 of the grinding portion 21. As shown, the forward 23 and rear 35 flat surfaces are of the same aggressive or coarse quality, though the rear surface 35 may be more coarse than the front surface 23, while the V surfaces 29 and 33 are of significantly less aggressive or less coarse quality than the flat surfaces 23 and 35. Furthermore, while the forward flat surface 23 is preferably less aggressive or coarse than the rear flat surface 33 it may, in some applications, be eliminated all together, as for example, when grinding a V-profile at the front edge of a circular lens. Furthermore, the flat surfaces 23 and 35 are slightly inclined so that the radii from the axis 13 of the wheel 10 to the outer edges of the flat surfaces 23 and 35 are greater than the radii from the center line 13 of the wheel 10 to the inner edges of the flat surfaces 23 and 35 so as to align the wheel 10 properly with the lens during free float grinding.

In light of the foregoing description of the operation of a typical free floating grinder, it will be seen that as the improved grinding wheel 10 comes into contact with the edge of the lens to be ground to a V-profile, the aggressive flat surfaces 23 and 35 will quickly remove material along the lens edge except for that narrow band coincident with the open end of the V-portion 27 of the wheel 10. Consequently, regardless of the thickness of the lens edge being profiled, all lenses, be they plus power P, plano O or minus power M, will have substantially equal times of application of the V surfaces 29 and 33 to the same width narrow band, thus minimizing the deviation in diameter caused by inconsistency in the grinding cycle resulting from differences in lens edge thickness. While the use of the improved V-profile grinding wheel has been explained in relation to a free float application, the wheel is also effective in use with controlled mode grinding equipment.

Thus, it is apparent that there has been provided, in accordance with the invention, a free float grinding wheel that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A grinding wheel comprising a rigid circular body having a V-shaped groove circumferentially thereabout defining a forward V surface and a rear V surface meeting at a nadir of said groove and a rear flat surface tapering outwardly in relation to an axis of rotation of said wheel from a rear edge of said rear V surface toward a rear face of said wheel, said forward V surface being of first grinding aggressiveness, said rear V surface being of second grinding aggressiveness greater than said first grinding aggressiveness and said rear flat surface being of third grinding aggressiveness substantially greater than said second grinding aggressiveness.

2. A grinding wheel comprising a rigid circular body having a V-shaped groove circumferentially thereabout defining a forward V surface and a rear V surface meeting at a nadir of said groove, a forward flat surface tapering outwardly in relation to an axis of rotation of said wheel from a forward edge of said forward V surface toward a forward face of said wheel and a rear flat surface tapering outwardly in relation to said axis of rotation of said wheel from a rear edge of said rear V surface toward a rear face of said wheel, said forward V surface being of first grinding aggressiveness, said rear V surface being of second grinding aggressiveness greater than said first grinding aggressiveness, said forward flat surface being of third grinding aggressiveness substantially greater than said second grinding aggressiveness and said rear flat surface being of fourth grinding aggressiveness equal to or greater than said third grinding aggressiveness.

* * * * *